US010444652B2

(12) United States Patent
Watanabe

(10) Patent No.: US 10,444,652 B2
(45) Date of Patent: Oct. 15, 2019

(54) IMAGE FORMING APPARATUS

(71) Applicant: FUJI XEROX CO., LTD., Tokyo (JP)

(72) Inventor: Kanji Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/786,587

(22) Filed: Oct. 17, 2017

(65) Prior Publication Data

US 2018/0239270 A1 Aug. 23, 2018

(30) Foreign Application Priority Data

Feb. 17, 2017 (JP) ..... 2017-028309

(51) Int. Cl.

| | |
|---|---|
| ***G03G 15/16*** | (2006.01) |
| ***G03G 15/02*** | (2006.01) |
| ***G03G 15/01*** | (2006.01) |
| ***G03G 15/20*** | (2006.01) |
| ***G03G 15/08*** | (2006.01) |
| ***G03G 15/00*** | (2006.01) |

(52) U.S. Cl.

CPC ..... *G03G 15/0225* (2013.01); *G03G 15/011* (2013.01); *G03G 15/0808* (2013.01); *G03G 15/0849* (2013.01); *G03G 15/168* (2013.01); *G03G 15/2064* (2013.01); *G03G 15/652* (2013.01); *G03G 15/161* (2013.01); *G03G 2215/1652* (2013.01)

(58) Field of Classification Search

CPC ..... G03G 15/168; G03G 2215/1647; G03G 2215/1652; G03G 2215/1657

See application file for complete search history.

(56) References Cited

U.S. PATENT DOCUMENTS

2005/0031383 A1* 2/2005 Watanabe ..... G03G 15/75 399/297
2006/0227202 A1* 10/2006 Suzuki ..... G03G 15/0131 347/132
2007/0206970 A1* 9/2007 Izumi ..... G03G 15/0131 399/101

FOREIGN PATENT DOCUMENTS

| | | |
|---|---|---|
| JP | 01-093778 | 4/1989 |
| JP | 03-284566 | 12/1991 |
| JP | 05-181338 | 7/1993 |
| JP | 2004177865 A * | 6/2004 |
| JP | 2015-025920 | 2/2015 |

OTHER PUBLICATIONS

Machine translation of Tanimoto (2004).*
Yamamoto et al., <u>Electrophotographic Color Printer Engine</u>, OKI Technical Review</i>, vol. 64, p. 15 (Aug. 1998) (Year: 1998).*

* cited by examiner

*Primary Examiner* — Sevan A Aydin
(74) *Attorney, Agent, or Firm* — JCIPRNET

(57) ABSTRACT

An image forming apparatus includes an image holding body, a transfer member, and a controller. The image holding body holds an unfixed image. The transfer member presses a continuous medium against the image holding body and causes the image to be transferred to the medium. The controller allows a cleaning operation in which undesired adhering matter adhering to the transfer member is transferred to the image holding body to be performed when the medium does not exist between the image holding body and the transfer member.

10 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2017-028309 filed Feb. 17, 2017.

BACKGROUND

Technical Field

The present invention relates to an image forming apparatus.

SUMMARY

According to an aspect of the present invention, an image forming apparatus includes an image holding body, a transfer member, and a controller. The image holding body holds an unfixed image. The transfer member presses a continuous medium against the image holding body and causes the image to be transferred to the medium. The controller allows a cleaning operation in which undesired adhering matter adhering to the transfer member is transferred to the image holding body to be performed when the medium does not exist between the image holding body and the transfer member.

BRIEF DESCRIPTION OF THE DRAWINGS

Exemplary embodiments of the present invention will be described in detail based on the following figures, wherein.

DETAILED DESCRIPTION

Exemplary embodiments according to the present invention (referred to as "exemplary embodiments" or "exemplary embodiment" hereafter) will be described below with reference to the drawings.

First Exemplary Embodiment

Figure 1:
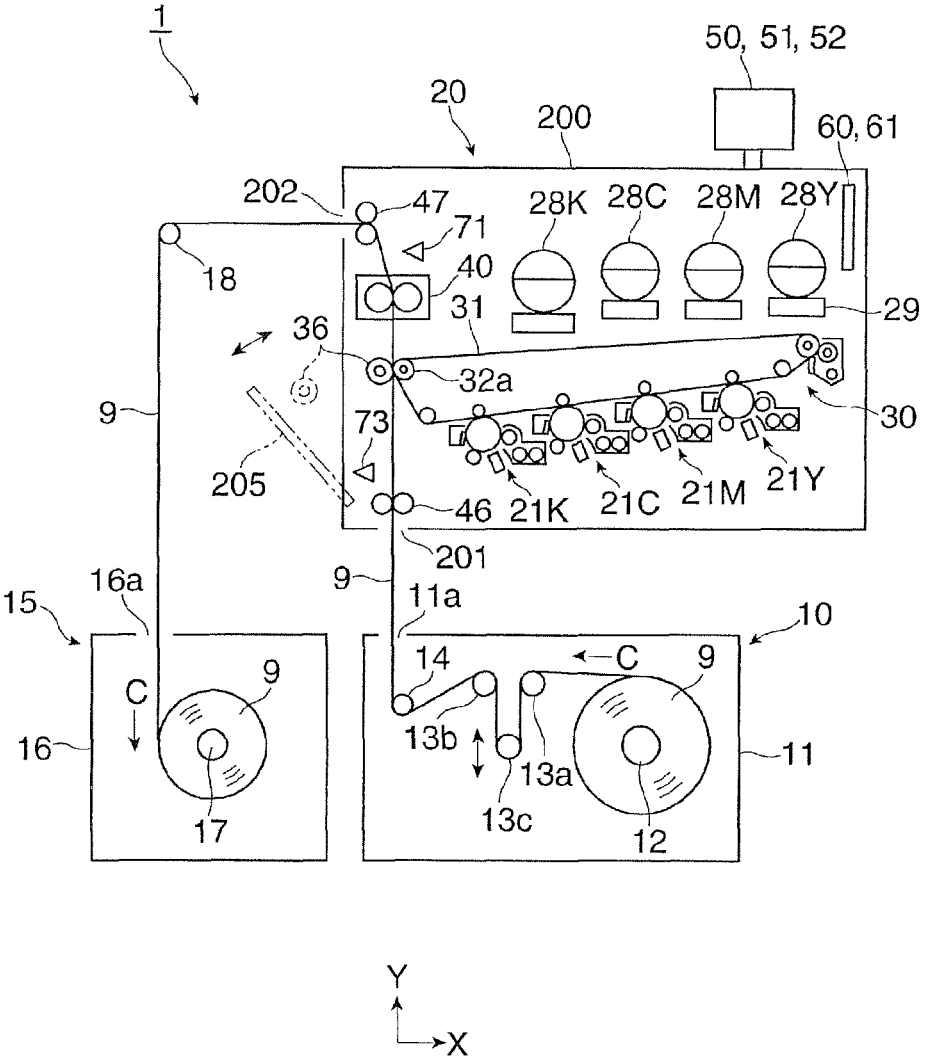
FIG. 1 is an explanatory view of the structure of an image forming apparatus according to a first exemplary embodiment or other embodiments.
Figure 2:
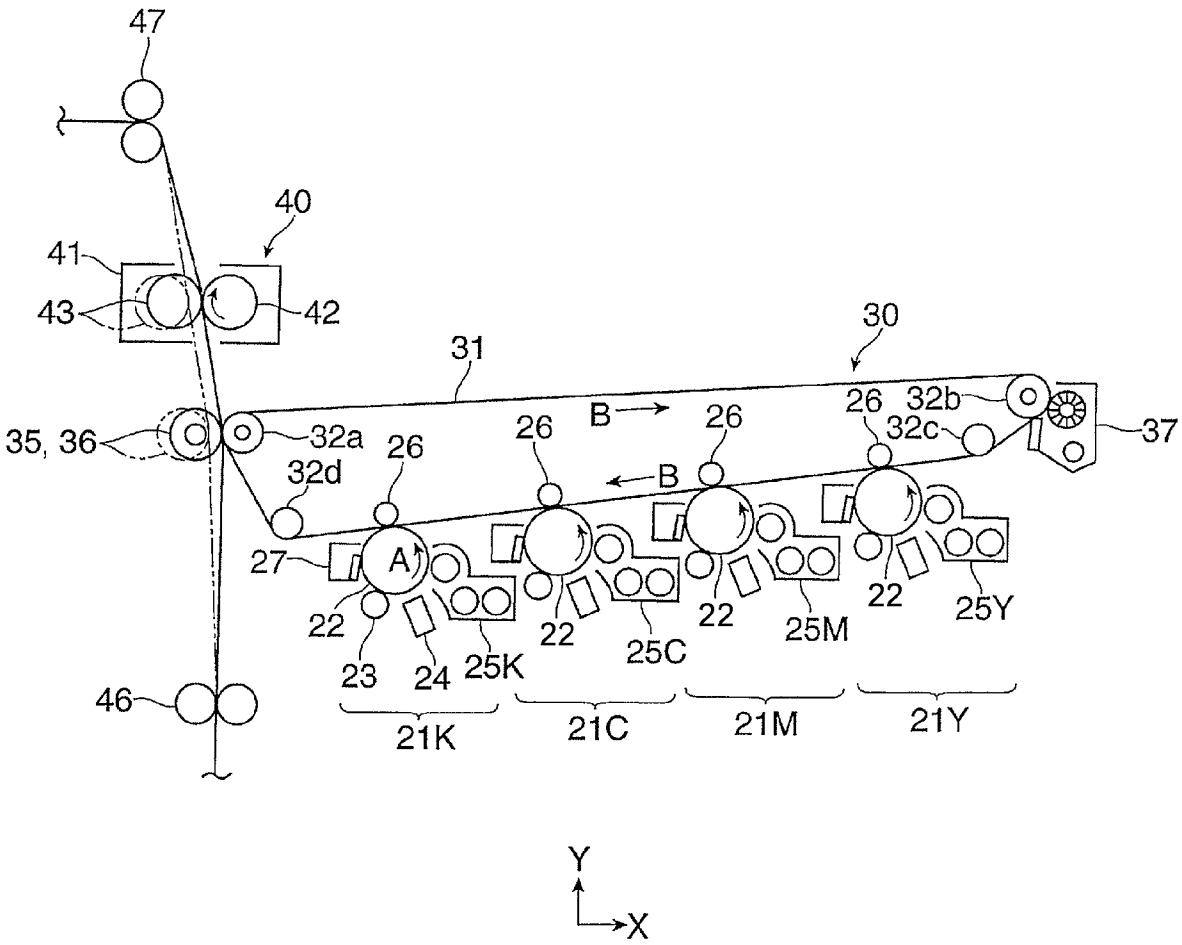
FIG. 2 is an enlarged explanatory view of elements of an image forming section of the image forming apparatus illustrated in FIG. 1.

FIGS. 1 and 2 illustrate an image forming apparatus and so forth according to a first exemplary embodiment. FIG. 1 is a schematic structural view of the entirety of the image forming apparatus. FIG. 2 is an enlarged view of elements of the structure of an image forming section of the image forming apparatus. Arrows illustrated in, for example, FIG. 1 and denoted by signs "X", "Y", and "Z" are (the directions of) the axes of rectangular coordinates indicating the width, height, and the depth directions of a three-dimensional space assumed in each of the drawings.

An Overall Structure of the Image Forming Apparatus

As illustrated in FIG. 1, an image forming apparatus 1 according to the first exemplary embodiment forms images on continuous paper 9 that serves as an example of a continuous medium. This image forming apparatus 1 includes, as illustrated in FIG. 1, a supply section 10, an image forming section 20, and a receiving section 15. The supply section 10 supplies the continuous paper 9. The image forming section 20 forms various images on the continuous paper 9 supplied from the supply section 10. The receiving section 15 receives the continuous paper 9 fed from the image forming section 20.

The supply section 10 includes, for example, a feed shaft 12, a tension applying transport device 13, and a guide roller 14 disposed in a housing 11. The feed shaft 12 feeds the continuous paper 9 wound so as to have a roll shape and attached to the feed shaft 12. The tension applying transport device 13 transports the continuous paper 9 fed from the feed shaft 12 while applying tension to the continuous paper 9. The guide roller 14 guides the continuous paper 9 having passed through the tension applying transport device 13 toward the image forming section 20.

The feed shaft 12 has a structure that allows the roll-shaped continuous paper 9 to be removably attached to the feed shaft 12. The feed shaft 12 is rotated by a drive device (not illustrated) at a required speed. The tension applying transport device 13 includes, for example, two transport support rollers 13*a* and 13*b* and an up-down roller 13*c*. The transport support rollers 13*a* and 13*b* are spaced from each other and substantially parallel to the feed shaft 12. The up-down roller 13*c* for applying tension is movable in the up-down direction between the two transport support rollers 13*a* and 13*b*. The guide roller 14 is disposed at a position where the guide roller 14 is able to feed the continuous paper 9 having passed through the tension applying transport device 13 to the image forming section 20 through a feed opening 11*a* of the housing 11. A direction indicated by an arrow C in, for example, FIG. 1 is a transport direction of the continuous paper 9.

The receiving section 15 includes, for example, a take-up shaft 17 disposed in a housing 16. The continuous paper 9 having passed through the image forming section 20 is wound on the take-up shaft 17. Furthermore, the receiving section 15 is provided with a guide roller 18 disposed outside the housing 16. The guide roller 18 guides the continuous paper 9 fed from the image forming section 20 toward the receiving section 15. The take-up shaft 17 is structured such that the continuous paper 9 is removable after having been wound so as to have a roll shape. The take-up shaft 17 is rotated by a drive device (not illustrated). The guide roller 18 is disposed at a position where the guide roller 18 is able to feed the continuous paper 9 fed from the image forming section 20 to a winding position of the take-up shaft 17 through a receiving opening 16*a* of the housing 16.

An elongated material continuing to have a band shape formed of, for example, paper such as fine paper or coated paper or synthetic resin or the like such as polypropylene is used as the continuous paper 9. Other than the above-described material, for example, continuous label paper having a structure in which a surface base material (image forming surface) is provide on release paper with an adhesive layer interposed therebetween is used as the continuous paper 9. A roll of the continuous paper 9 is able to be replaced with, during the continuous paper 9 is being used, another roll of continuous paper 9 having a different feed width W (see FIG. 8) that is a dimension substantially perpendicular to the transport direction C.

For example, an electrophotographic recording system is used for the image forming section 20. Specifically, as illustrated in FIGS. 1 and 2, the image forming section 20 includes, for example, image forming devices 21, an intermediate transfer device 30, and a fixing device 40 disposed in a housing 200. The image forming devices 21 each form a toner image made of toner serving as developer. The intermediate transfer device 30 holds the toner images formed by the image forming devices 21 and transports the toner images to a second transfer position where the toner images are transferred onto the continuous paper 9 at last, so that the toner images are transferred. The fixing device 40 fixes the toner images transferred onto the continuous paper 9. The housing 200 has, for example, an introduction opening 201 formed in its lower surface portion and an exit opening 202 formed in its side surface portion. The continuous paper 9 passes through the introduction opening 201 so as to be introduced and the exit opening 202 so as to exit.

The image forming devices 21 include four image forming devices 21Y, 21M, 21C, and 21K. The image forming devices 21Y, 21M, 21C, and 21K each form a toner image of a corresponding one of four colors, that is, yellow (Y), magenta (M), cyan (C), and black (K).

The image forming devices 21Y, 21M, 21C, and 21K each include a corresponding one of photosensitive drums 22 rotated in an arrow A direction. Components such as a charger 23, a light exposure device 24, a developing device 25, a first transfer device 26, and a drum cleaner 27 are disposed around the photosensitive drum 22. Out of these components, the charger 23 receives supply of a charging current, thereby charging an image forming surface of the photosensitive drum 22. The light exposure device 24 radiates light in accordance with image information (signal) toward the charged image forming surface of the photosensitive drum 22, thereby forming an electrostatic latent image. The image information connected or input to the image forming apparatus 1 from the outside through a communication unit or the like is subjected to required processing such as image processing and input to the light exposure device 24 as an image signal. The developing device 25 receives supply of a developing current or the like, thereby developing with toner as developer the electrostatic latent image formed on the image forming surface of the photosensitive drum 22. Thus, a toner image is formed. The first transfer device 26 receives supply of a first transfer current, thereby transferring through first transfer the toner image formed on the image forming surface of the photosensitive drum 22 to (an outer circumferential surface of an intermediate transfer belt 31 of) the intermediate transfer device 30. The drum cleaner 27 cleans the image forming surface of the photosensitive drum 22 by removing undesired matter such as toner remaining on and adhering to the image forming surface of the photosensitive drum 22.

The intermediate transfer device 30 includes the intermediate transfer belt 31 serving as an example of an image holding body that, while being rotated in an arrow B direction, passes through first transfer positions of the photosensitive drums 22 of the four image forming devices 21Y, 21M, 21C, and 21K facing the respective first transfer devices 26. The intermediate transfer belt 31 is looped over and supported by a second transfer backup roller 32*a*, drive roller 32*b* that also functions as a tension applying roller, follower rollers 32*c* and 32*d* that hold a first transfer surface of the intermediate transfer belt 31, and the like. The intermediate transfer device 30 also includes, for example, a second transfer device 35 and a belt cleaner 37. The second transfer device 35 transfers onto the continuous paper 9 through second transfer the toner images having been transferred onto the intermediate transfer belt 31 through first transfer. The belt cleaner 37 cleans the outer circumferential surface of the intermediate transfer belt 31 by removing undesired matter such as toner remaining on and adhering to the outer circumferential surface of the intermediate transfer belt 31.

The second transfer device 35 includes a second transfer roller 36 that serves as an example of a transfer member. The second transfer roller 36 presses the continuous paper 9 against a portion of the outer circumferential surface of the intermediate transfer belt 31 supported by the second transfer backup roller 32*a* and transfers through second transfer the toner images on the intermediate transfer belt 31 onto the continuous paper 9. Furthermore, as illustrated in FIG. 2, the second transfer device 35 is moved between a position where the second transfer roller 36 is in contact with the outer circumferential surface of the intermediate transfer belt 31 (the position of the second transfer roller 36 indicated by a solid line) and a position where the second transfer roller 36 is kept separated from the outer circumferential surface of the intermediate transfer belt 31 (the position of the second transfer roller 36 indicated by a broken line) by operation of a contact/separation mechanism (not illustrated). When the continuous paper 9 exists between the second transfer roller 36 and the outer circumferential surface of the intermediate transfer belt 31, the second transfer roller 36 is to be in contact with the outer circumferential surface of the intermediate transfer belt 31 with this continuous paper 9 interposed therebetween.

The fixing device 40 includes, for example, a heating rotating body 42 and a pressure rotating body 43 disposed in a housing 41 having an introduction opening and an exit opening for the continuous paper 9. The heating rotating body 42 is rotated in a required direction and heated by a heating unit so that the surface temperature of the heating rotating body 42 is maintained at a required temperature. The heating rotating body 42 is in the form of a roller, a belt, or the like. The pressure rotating body 43 is to be in pressure contact with the heating rotating body 42 in the rotational axis direction of the heating rotating body 42 at a required pressure so as to be rotated by the heating rotating body 42. The pressure rotating body 43 is in the form of a roller, a belt, a belt pad, or the like.

In this fixing device 40, a pressure contact portion where the heating rotating body 42 and the pressure rotating body 43 are in pressure contact with each other serves as a fixing process portion where the continuous paper 9 holding toner images are introduced and subjected to a fixing process (heating and applying pressure). Furthermore, as illustrated in FIG. 2, the pressure rotating body 43 is moved between a position where the pressure rotating body 43 is in contact with an outer circumferential surface of the heating rotating body 42 (the position of the pressure rotating body 43 indicated by a solid line) and a position where the pressure rotating body 43 is kept separated from the outer circumferential surface of the heating rotating body 42 (the position of the pressure rotating body 43 indicated by a broken line) by operation of a contact/separation mechanism (not illustrated) in the fixing device 40. When the continuous paper 9 exists between the pressure rotating body 43 and the outer circumferential surface of the heating rotating body 42, the pressure rotating body 43 is to be in contact with the outer circumferential surface of the heating rotating body 42 with this continuous paper 9 interposed therebetween.

Furthermore, for the image forming section 20, for example, a follower-type introduction transport roller pair 46 and a follower-type exit transport roller pair 47 are disposed in the housing 200. The introduction transport roller pair 46 transports the continuous paper 9 fed from the supply section 10 so that the continuous paper 9 is introduced to the second transfer position of the intermediate transfer device 30. The exit transport roller pair 47 transports the continuous paper 9 having passed through the fixing device 40 so that the continuous paper 9 is caused to exit. Furthermore, detachable developer cartridges 28Y, 28M, 28C, and 28K, replenishment devices 29, and so forth are disposed in the housing 200. The developer cartridges 28Y, 28M, 28C, and 28K each contain toner and the like with which a corresponding one of the developing devices 25Y, 25M, 25C, and 25K of the image forming devices 21Y, 21M, 21C, and 21K is replenished. The replenishment devices 29 feed required amounts of the toner and the like from the developer cartridges 28Y, 28M, 28C, and 28K to the developing device 25Y, 25M, 25C, and 25K at specified timing.

Furthermore, for the image forming section 20, an operating display 50 is disposed outside the housing 200. The operating display 50 includes an input unit 51 and a display 52. Information such as instructions of operation and settings of conditions of the image forming apparatus 1 is input through the input unit 51. The display 52 displays information about, for example, operating states, the details of settings, and the details of operation of the image forming apparatus 1. Furthermore, a central controller 60 is disposed in the housing 200. The central controller 60 controls operations of the supply section 10, the image forming section 20, the receiving section 15, the operating display 50, and so forth.

The image forming apparatus 1 also includes a transfer unit access door 205. As represented by an example illustrated in, for example, FIGS. 1 and 6A, the transfer unit access door 205 is part of a side surface portion of the housing 200 made to be openable so as to expose to the outside the second transfer position (transfer portion) of the intermediate transfer device 30 and a region around the second transfer position for performing required work typical examples of which are loading work and inspection work for, for example, loading and replacing the continuous paper 9 in the image forming section 20. The transfer unit access door 205 is opened and closed by, for example, being rotated in double sided arrow directions about a support axis 206 existing at a lower end of the transfer unit access door 205. Furthermore, for example, the second transfer roller 36 of the second transfer device 35 is mounted on the transfer unit access door 205.

Basic Image Forming Operation

A basic image forming operation (printing operation) described below is performed with such an image forming apparatus 1. Here, an example of the case of formation of a multi-color image, that is, a so-called full-color image formed by combining toner images of four colors (Y, M, C, and K) is described.

Upon receiving, by the central controller 60, an instruction requesting an image forming operation, the four image forming devices 21Y, 21M, 21C, and 21K of the image forming section 20 substantially similarly start to form toner images in the image forming apparatus 1.

First, in each of the image forming devices 21Y, 21M, 21C, and 21K, the photosensitive drum 22 starts to be rotated in the arrow A direction and the charger 23 is operated by receiving supply of a charging current. This causes the image forming surface of the photosensitive drum 22 to be charged to a required polarity (for example, negative polarity) and a required surface potential. Next, the light exposure device 24 is operated by receiving an image signal of a corresponding one of the four color components (Y, M, C, and K) separated in accordance with the image information input from the outside, thereby the light exposure device 24 radiates drawing light corresponding to the image signal toward the charged image forming surface of the photosensitive drum 22. As a result, an electrostatic latent image of the color component formed of a specified potential is separately formed on the image forming surface of the photosensitive drum 22. Next, each of the developing devices 25Y, 25M, 25C, and 25K receives supply of the developing current and is rotated to be operated, thereby supplying the toner of the color corresponding to the electrostatic latent image of the color component formed on the image forming surface of the photosensitive drum 22 so as to cause the toner to electrostatically adhere to the electrostatic latent image. In this way, the toner images of four colors (Y, M, C, and K) are separately formed on the image forming surfaces of the respective photosensitive drums 22.

Next, the toner images of the colors formed on the photosensitive drums 22 of the image forming devices 21Y, 21M, 21C, and 21K are transferred onto the continuous paper 9 through the intermediate transfer device 30 of the image forming section 20.

First, in each of the image forming devices 21Y, 21M, 21C, and 21K, the toner image of the corresponding color formed on the photosensitive drum 22 is transported by rotation of the photosensitive drum 22 to the first transfer position where the toner image faces the intermediate transfer belt 31. The toner image of the colors is electrostatically transferred through first transfer onto the outer circumferential surface of the intermediate transfer belt 31 by action of a transfer electric field formed between the first transfer device 26 and the photosensitive drum 22 due to supply of a first transfer current to the first transfer device 26. Furthermore, the image forming surface of the photosensitive drum 22 after, for example, the first transfer is cleaned by removing undesired matter such as toner by using the drum cleaner 27.

Next, in the intermediate transfer device 30, the toner images having been transferred through first transfer onto the outer circumferential surface of the intermediate transfer belt 31 is transported by rotation of the intermediate transfer belt 31 in the arrow B direction to the second transfer position where the toner images face the second transfer roller 36 of the second transfer device 35. Meanwhile, the continuous paper 9 in the supply section 10 is subjected to the following transport forces: a transport force at the second transfer position in the intermediate transfer device 30 of the image forming section 20; a transport force in a transfer process portion of the fixing device 40 of the image forming section 20; and a transport force caused by the take-up shaft 17 of the receiving section 15. As a result, the continuous paper 9 is fed from the feed shaft 12 by a required length through the tension applying transport device 13 and the guide roller 14, and then, the continuous paper 9 is transported so as to be introduced into the image forming section 20 through the introduction transport roller pair 46.

Thus, the toner images on the intermediate transfer belt 31 are, due to action of a transfer electric field formed between the second transfer device 35 and the second transfer backup roller 32*a* that receives supply of a second transfer current, electrostatically transferred through second transfer at their second transfer position to the continuous paper 9 being pressed against the outer circumferential surface of the intermediate transfer belt 31 by the second transfer roller 36. The outer circumferential surface of the intermediate transfer belt 31 after, for example, the second transfer is cleaned by removing undesired matter such as toner using the belt cleaner 37.

Next, the toner images having been transferred through the second transfer onto the continuous paper 9 are fixed by the fixing device 40 of the image forming section 20. The continuous paper 9 onto which the above-described toner images have been transferred through the second transfer is transported so as to be introduced into and pass through the fixing process portion between the heating rotating body 42 and the pressure rotating body 43 of the fixing device 40. During this passage, the continuous paper 9 is heated under pressure. This causes the toner included in the toner images to be fused, thereby the toner images are fixed onto the continuous paper 9.

At last, the continuous paper 9 on which an image is formed when the fixing is finished is subjected to the transport force applied by the take-up shaft 17 of the receiving section 15. Accordingly, the continuous paper 9 is wound on the take-up shaft 17 after being transported to the receiving section 15 through the exit transport roller pair 47 and the guide roller 18.

A full-color image formed by combining the toner images of the four colors is formed on one side of the continuous paper 9 by performing the image forming operation described above.

In this image forming apparatus 1, when preset separation time comes, for example, time when a series of processes of the image forming operation are completed comes, as exemplified by the broken line in FIG. 2, the second transfer roller 36 of the second transfer device 35 and the pressure rotating body 43 of the fixing device 40 are moved to respective separate positions. As a result, while the continuous paper 9 is held by being subjected to tension applied thereto by the introduction transport roller pair 46 and the exit transport roller pair 47, the continuous paper 9 is released from contact with the intermediate transfer belt 31 of the intermediate transfer device 30 and contact with the heating rotating body 42 of the fixing device 40.

Furthermore, in this image forming apparatus 1, when preset contact time comes, for example, time when the image forming operation is started comes, as illustrated by the solid line in FIG. 2, the second transfer roller 36 of the second transfer device 35 and the pressure rotating body 43 of the fixing device 40 are moved to respective contact positions. Thus, the continuous paper 9 is brought into contact with the intermediate transfer belt 31 of the intermediate transfer device 30 and the heating rotating body 42 of the fixing device 40.

Structure Relating to a Cleaning Operation for the Second Transfer Roller

In this image forming apparatus 1, as the number of times of the image forming operation increases, the second transfer roller 36 of the second transfer device 35 becomes smudged with undesired adhering matter such as toner and paper dust, in most cases, electrostatically adhered to the second transfer roller 36.

Figure 8:
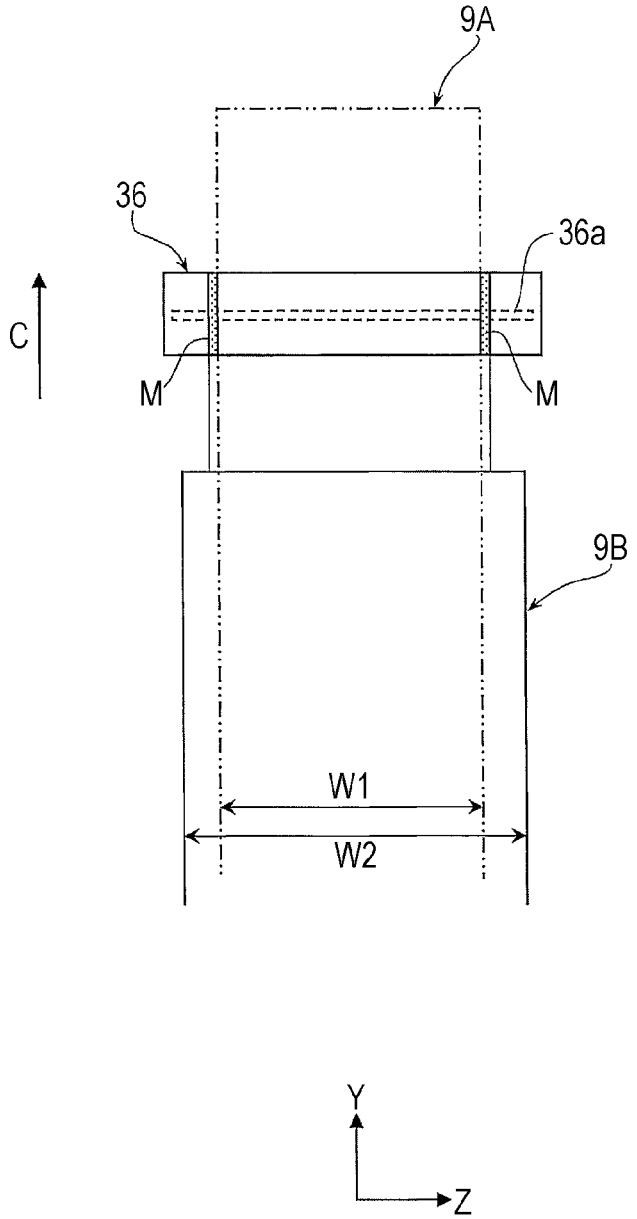
FIG. 8 is an explanatory view illustrating the relationships between old continuous paper having a small feed width, new (replacement) continuous paper having a large feed width, and smudges on the back side of the new continuous paper.

Smudges M with the undesired adhering matter adhering to the second transfer roller 36 tend to be, as illustrated in FIG. 8, markedly observed at portions of the outer circumferential surface of the second transfer roller 36 not in contact with the continuous paper 9. Such smudges M made by, for example, transfer and adherence of toner at left and right end portions of the intermediate transfer belt 31 not in contact with the continuous paper 9 during formation through first transfer of a toner image for, for example, image quality adjustment, or adherence of toner suspended in the housing 200. Reference sign 36*a* for broken lines illustrated in FIG. 8 denotes a portion of the second transfer roller 36 in contact with the intermediate transfer belt 31 at the second transfer position.

Furthermore, when the smudges M of the second transfer roller 36 exist, for example, left and right end portions of the front side of the continuous paper 9 and the back side of the continuous paper 9 (the side brought into contact with the second transfer roller 36) during transport of the continuous paper 9 may be smudged. Smudging of the left and right end portions and the back side of the continuous paper 9 caused by the smudges M of the second transfer roller 36 is likely to occur after the continuous paper 9 has been replaced. That is, when a feed width W of the continuous paper 9 after replacement (hereafter, the continuous paper 9 or the like after replacement is referred to as "new continuous paper 9" or the like) is the same as that of the continuous paper 9 before replacement (hereafter, the continuous paper 9 or the like before replacement is referred to as "old continuous paper 9" or the like), the new continuous paper 9 may be brought into contact with and pass through a position that is, in the axial direction of the second transfer roller 36, slightly deviated from a position where the old continuous paper 9 was brought into contact. This may cause the left and right end portions and the back side of the continuous paper 9 to be smudged. In particular, as exemplified in FIG. 8, in the case where old continuous paper 9A is replaced with continuous paper 9B having a larger feed width W2 than a feed width W1 of the old continuous paper 9A (W2>W1), smudging is likely to be made in portions of the back side of the new continuous paper 9B outside the feed width W1 of the old continuous paper 9A.

Figure 3:
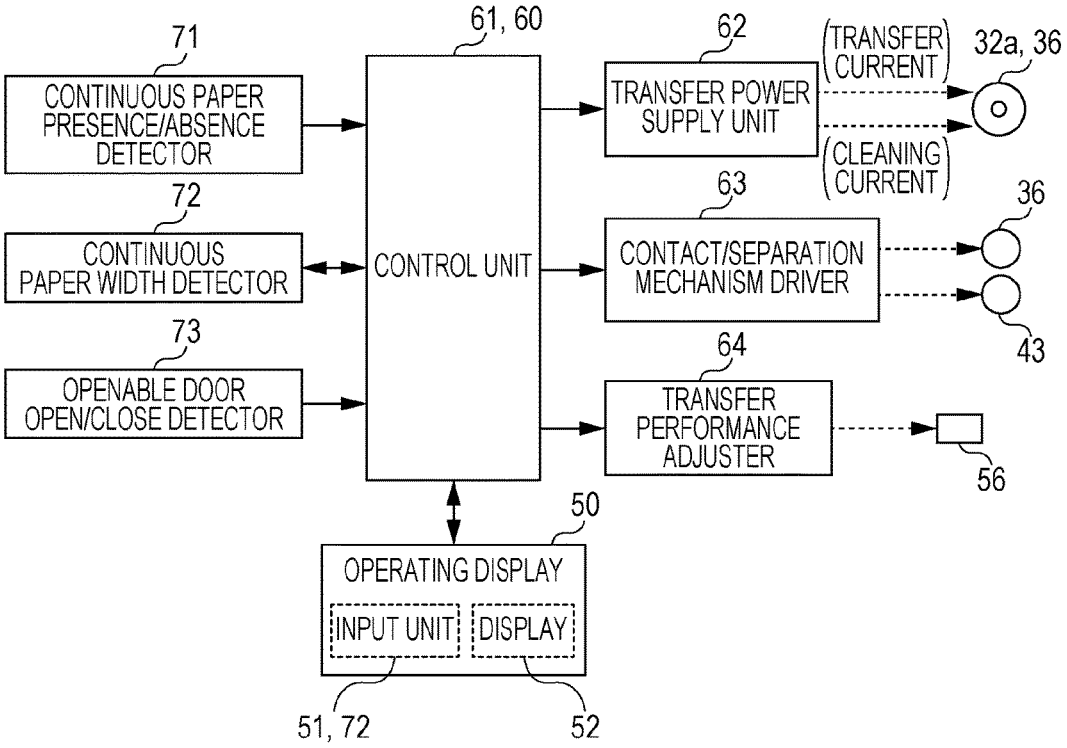
FIG. 3 is a block diagram of part of the configuration of a control system of the image forming apparatus illustrated in FIG. 1.
Figure 4:
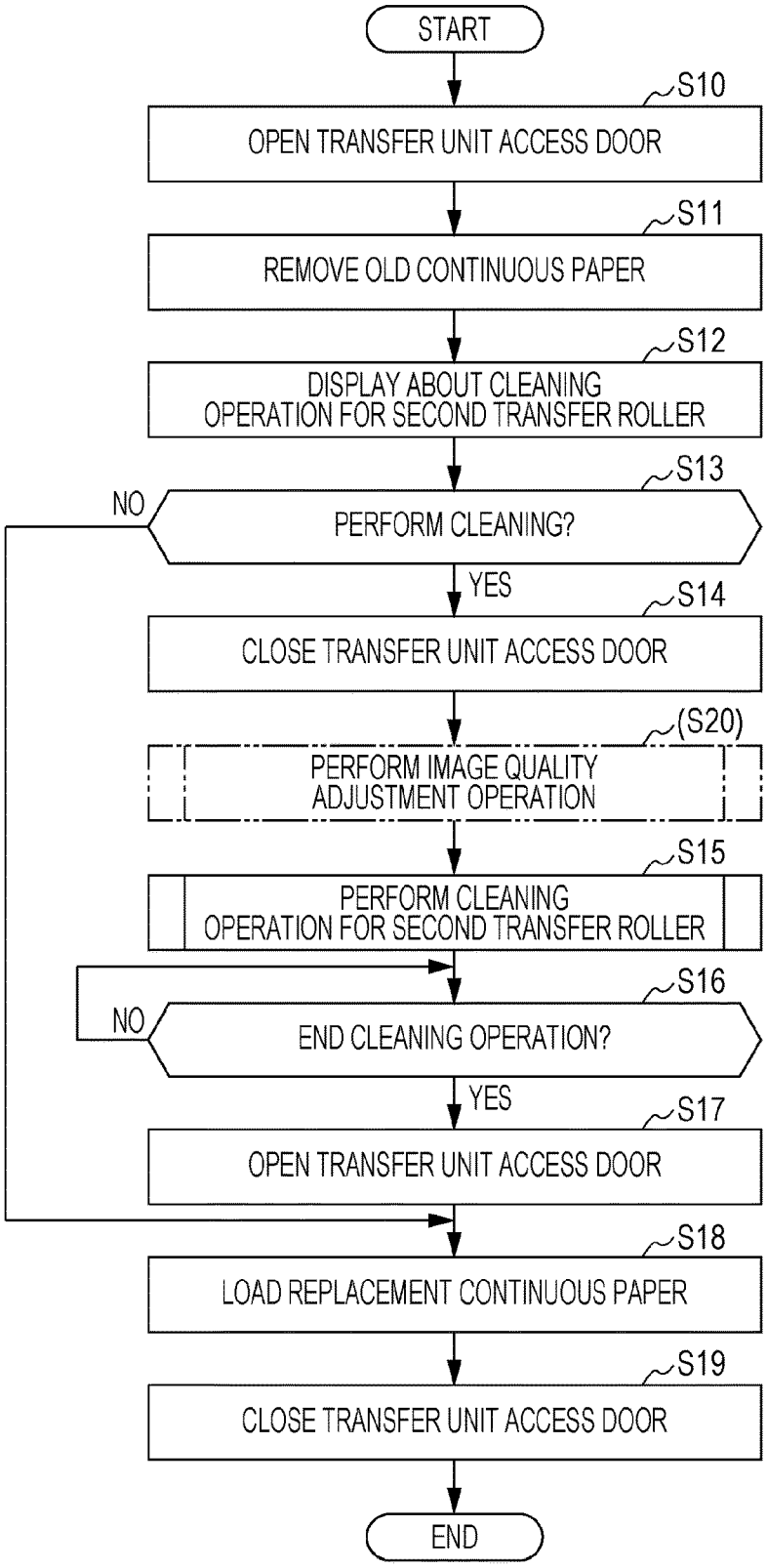
FIG. 4 is a flowchart illustrating procedures of replacement of continuous paper and a cleaning operation for a second transfer roller.
Figure 5:
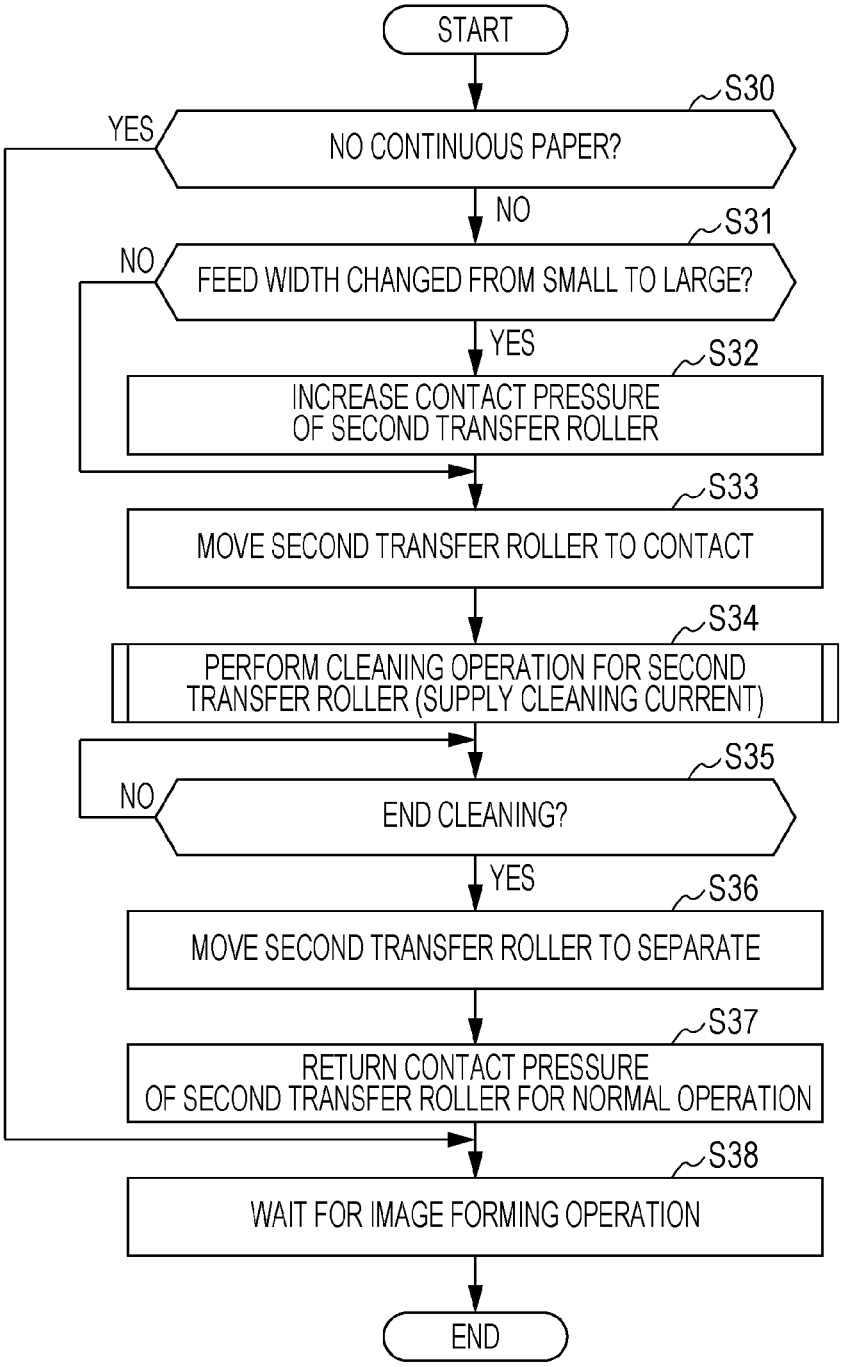
FIG. 5 is a flowchart illustrating a procedure of the cleaning operation for the second transfer roller.

Accordingly, as illustrated in, for example, FIGS. 3 to 5, this image forming apparatus 1 includes a controller (control unit) 61 that allows the following cleaning operation to be performed: undesired adhering matter adhering to the second transfer roller 36 is transferred to the intermediate transfer belt 31 when there is no continuous paper 9 between the intermediate transfer belt 31 and the second transfer roller 36.

The controller 61 includes, for example, an arithmetic processing unit, a memory element, a memory, an input/output device, and so forth. The controller 61 is operated corresponding to a program and control data stored in the memory element or the like, thereby controlling operations of components as control targets in accordance with required details. The controller 61 may be separated from the central controller 60 or part of the central controller 60.

As illustrated in FIG. 3, this controller 61 is connected to control targets such as the transfer power supply unit 62, a contact/separation mechanism driver 63 of the contact/separation mechanism, an adjuster 64, and the operating display 50. The transfer power supply unit 62 serving as a power supply unit supplies a transfer current or the like to the second transfer backup roller 32*a*. The contact/separation mechanism driver 63 moves the second transfer roller 36 of the second transfer device 35 and the pressure rotating body 43 of the fixing device 40 to the respective contact positions and the respective separate positions. The adjuster 64 serving as an adjustment unit adjusts the transfer performance of the undesired adhering matter to the intermediate transfer belt 31 during the cleaning operation for the second transfer roller 36. The controller 61 transmits control signals required for the control targets. Furthermore, the controller 61 receives detection information output from detection units such as a presence/absence detection unit (presence/absence detector) 71, a width detection unit (width detector) 72, and an open/close detection unit (open/close detector) 73. The presence/absence detector 71 detects the presence/absence of the continuous paper 9 in the image forming section 20. The width detector 72 detects the feed width W of the continuous paper 9. The open/close detector 73 detects open/closed states of openable doors including the transfer unit access door 205.

As illustrated in FIG. 5, the configuration (program configuration) of the controller 61 is made such that the cleaning operation for the second transfer roller 36 is performed by supplying a cleaning current from the transfer power supply unit 62 to the second transfer backup roller 32*a*. The cleaning current is able to form an electric field with which undesired adhering matter is transferred from the second transfer roller 36 to the intermediate transfer belt 31. As the cleaning current, at least a current of the opposite polarity to the (second) transfer current is used. The magnitude of the cleaning current at this time may be the same as or different from that of the (second) transfer current. Furthermore, when it is assumed that adhering matter such as toner charged to the opposite polarity to the polarity to which the toner is normally charged exists on the second transfer roller 36, a current that alternately supplies the above-described current of the opposite polarity and a current of the same polarity as that of the (second) transfer current may be used as the cleaning current.

Furthermore, as illustrated in FIG. 4, the controller 61 assumes a time period during which the continuous paper 9 is removed from the supply section 10, the image forming section 20, and the receiving section 15 for, for example, replacement of the continuous paper 9 as a time period during which there is no continuous paper 9 between the intermediate transfer belt 31 and the second transfer roller 36. Thus, a state in which there is no continuous paper 9 between the intermediate transfer belt 31 and the second transfer roller 36 is able to be ensured. It is noted that, in the image forming apparatus 1, in order to more exactly recognize the presence/absence or loading of the continuous paper 9, the presence/absence detector (detection sensor) 71 that actually detects the presence/absence of the continuous paper 9 is provided at a position near a continuous paper exit side of the fixing device 40 of the image forming section 20 as illustrated in FIG. 1.

Furthermore, the controller 61 performs control, so that, as illustrated in FIG. 4, when the transfer unit access door 205 used when replacing the continuous paper 9 is opened, the cleaning operation for the second transfer roller 36 is started after the transfer unit access door 205 has been closed again. The control to start the cleaning operation at this time assumes the case where there is no continuous paper 9 between the intermediate transfer belt 31 and the second transfer roller 36 when the transfer unit access door 205 is opened. Furthermore, opening and closing of the transfer unit access door 205 are detected by the openable door open/close detector 73 provided near the transfer unit access door 205 in the image forming section 20.

Furthermore, as illustrated in FIG. 4, the controller 61 performs control, so that, as illustrated in FIG. 4, when the transfer unit access door 205 used when replacing the continuous paper 9 is opened, information describing the cleaning operation for the second transfer roller 36 is displayed in the display 52 serving as a display of the operating display 50. The description about the cleaning operation includes either or both of the details of operation when the user wishes the cleaning operation and the details of operation when the user does not wish the cleaning operation.

Furthermore, as illustrated in FIGS. 5 and 8, the controller 61 performs control so as to increase the transfer performance of the adjuster 64 that adjusts the transfer performance for transferring undesired adhering matter to the intermediate transfer belt 31 during the cleaning operation for the second transfer roller 36 when the new continuous paper 9B having the larger feed width W2 than the feed width W1 of the old continuous paper 9A is loaded through replacement of the continuous paper 9.

The width detector 72 that detects the feed width W of the continuous paper 9A asks the user to input information about the replacement continuous paper 9B including the feed width W2 and so forth through, for example, the input unit 51 of the operating display 50, detects whether or not the feed width W2 of the replacement continuous paper 9B is larger than the feed width W1 of the new continuous paper 9A (immediately) before being replaced, and outputs the result to the controller 61. The width detector 72 may be a detector that actually detects (actually measures) the feed width W of the continuous paper 9.

The adjuster 64 includes an adjustment mechanism 55 that adjusts a contact pressure of the second transfer roller 36 against the portion of the outer circumferential surface of the intermediate transfer belt 31 supported by the second transfer backup roller 32*a*. The adjustment mechanism 55 for a contact pressure includes, as illustrated in, for example, FIGS. 7A and 7B, a support member 38 and a cam mechanism 56. The support member 38 supports a rotational shaft 361 of the second transfer roller 36 such that the rotational shaft 361 is rotatable. The support member 38 is supported so as to be movable in a direction in which the support member 38 approaches and separates from the second transfer backup roller 32*a*. The cam mechanism 56 displaces the support member 38 in the direction in which the support member 38 approaches and separates from the second transfer backup roller 32*a*. The cam mechanism 56 includes eccentric cams. Each of the eccentric cams is rotated between a reference position where a contact pressure of the second transfer roller 36 for normal operation is generated and an increasing position where an increased contact pressure of the second transfer roller 36 for the cleaning operation is generated. Dotted chain lines 56*a* illustrated in FIGS. 7A and 7B indicate the rotational axis of the eccentric cams of the cam mechanism 56. It is also seen from FIGS. 7A and 7B that the second transfer backup roller 32*a* includes a rotational shaft 321 and a roller body 322, and the second transfer roller 36 includes the rotational shaft 361 and a roller body 362.

Relationship Between Replacement of the Continuous Paper and the Cleaning Operation As described below, the image forming apparatus 1 allows the cleaning operation for the second transfer roller 36 to be performed when replacing the continuous paper 9. The continuous paper 9 is replaced while the image forming operation is not performed on the continuous paper 9.

Figure 6A:
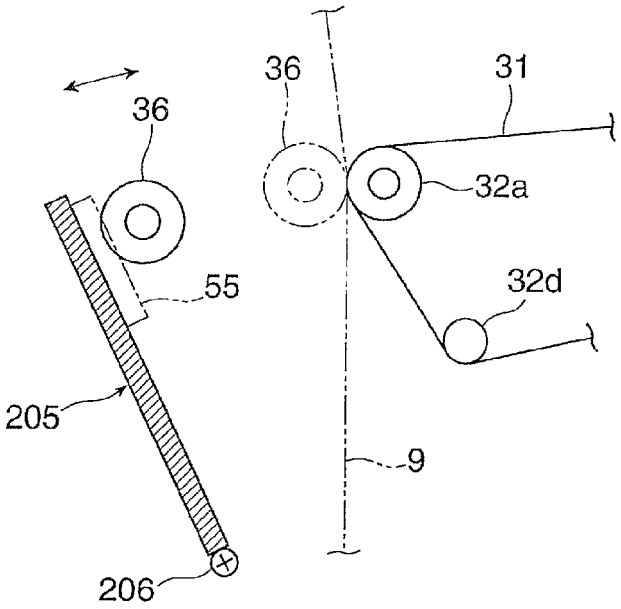
FIG. 6A is an explanatory view of a state of an opened transfer unit access door and the structure around the transfer unit access door.

In order to replace the continuous paper 9, first, as illustrated in FIGS. 4 and 6A, the user of the image forming apparatus 1 opens the transfer unit access door 205 (step 10; step 10 may be simply referred to as "S10" hereafter. This will be similarly applied to other steps). In so doing, the controller 61 recognizes that the transfer unit access door 205 has been open in accordance with detection information output from the openable door open/close detector 73. It is noted that replacement of other components of the image forming section 20 and necessary portions of the supply section 10 and the receiving section 15 are also able to be performed while replacement of the continuous paper 9 is being performed.

Next, after the transfer unit access door 205 has been opened, the user removes the continuous paper 9A before replacement (S11). In so doing, the controller 61 recognizes that the continuous paper 9A has been removed in accordance with detection information output from the continuous paper presence/absence detector 71.

Furthermore, when the transfer unit access door 205 is opened, a display about the cleaning operation for the second transfer roller 36 is displayed in the display 52 of the operating display 50 under the control of the controller 61 (S12). Information displayed at this time is as follows: information expressing the details of operation when the user wishes the cleaning operation, saying, for example, "When you wish the cleaning operation for the second transfer roller, close the transfer unit access door without loading the (replacement) continuous paper"; and information expressing the details of operation when the user does not wish the cleaning operation, saying, for example, "when you do not wish the cleaning operation for the second transfer roller, load the (replacement) continuous paper, and then, close the transfer unit access door". The image forming apparatus 1 may display only one of the above-described two pieces of information.

With the above-described display, the user is able to recognize a way of performing the cleaning operation when the user wishes the cleaning operation for the second transfer roller 36. Meanwhile, in the image forming apparatus 1, the cleaning operation for the second transfer roller 36 is able to be performed while the absence of the continuous paper 9 is ensured. Furthermore, the user is able to have an opportunity for selection when the user does not wish the cleaning of the second transfer roller 36. Meanwhile, in the image forming apparatus 1, performing the cleaning operation for the second transfer roller 36 is able to be prevented by securing the presence of the continuous paper 9.

Figure 6B:
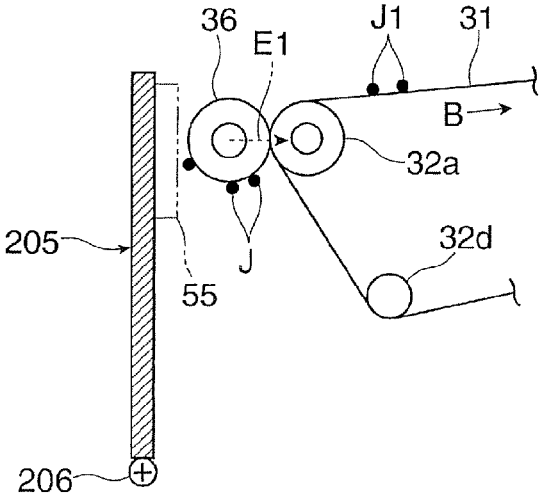
FIG. 6B is an explanatory view illustrating a state in which the transfer unit access door is closed and the cleaning operation for the second transfer roller is performed.

Regarding the display in step 12, when the user wishes the cleaning of the second transfer roller 36, the user closes the transfer unit access door 205 as illustrated in FIG. 6B. As a result, the cleaning operation for the second transfer roller 36 is performed under the control of the controller 61 (S13 to S15). In so doing, the controller 61 recognizes that the transfer unit access door 205 has been closed in accordance with detection information output from the openable door open/close detector 73. The cleaning operation for the second transfer roller 36 at this time is triggered by closing of the transfer unit access door 205. Furthermore, since the replacement continuous paper 9B has not been loaded, the cleaning operation at this time is performed while the absence of the continuous paper 9 is ensured. The details of the cleaning operation for the second transfer roller 36 will be described later.

Next, the cleaning operation for the second transfer roller 36 ends when, for example, a preset time period of cleaning is reached. If the end of the cleaning operation for the second transfer roller 36 is confirmed (S16), the user opens the transfer unit access door 205 (S17). In so doing, the controller 61 measures the elapsed time period of the cleaning operation for the second transfer roller 36 and recognizes the end of the cleaning operation when the required elapsed time period is reached.

Next, the user loads the replacement continuous paper 9B (S18), and then, closes the transfer unit access door 205 that has been open (S19). Thus, replacement of the continuous paper 9 is completed. In so doing, the controller 61 recognizes that the replacement continuous paper 9B has been loaded in accordance with detection information output from the continuous paper presence/absence detector 71.

In the image forming apparatus 1 at this time, the cleaning operation for the second transfer roller 36 is performed along with the replacement of the continuous paper 9. Accordingly, in the image forming apparatus 1 at this time, the image forming operation is able to be performed on the new continuous paper 9B having replaced the old continuous paper 9A in a state in which the second transfer roller 36 has been cleaned. Furthermore, when the image forming operation is performed on the new continuous paper 9 having replaced the old continuous paper 9A, smudging of the left and right end portions and the back side of the continuous paper 9B due to smudge of the second transfer roller 36 is avoidable.

In contrast, when the user does not wish the cleaning of the second transfer roller 36 in step 13, the user loads the replacement continuous paper 9B (S18), and then, closes the transfer unit access door 205 that has been open (S19).

In the image forming apparatus 1 at this time, only replacement of the continuous paper 9 is performed without performing the cleaning operation for the second transfer roller 36. Accordingly, in the image forming apparatus 1 at this time, the image forming operation is able to be quickly performed on the new continuous paper 9B having replaced the continuous paper 9A without setting a time period during which the image forming operation is not able to be performed (downtime) corresponding to a time period required for the cleaning operation for the second transfer roller 36.

Description of the Cleaning Operation for the Second Transfer Roller

As described above, the cleaning operation for the second transfer roller 36 is triggered by closing of the transfer unit access door 205 without loading the replacement continuous paper 9B (see details of the operation in S12 to S15 in FIG. 4).

For this cleaning operation, as illustrated in FIG. 5, first, it is confirmed that the continuous paper 9 between the intermediate transfer belt 31 and the second transfer roller 36 (S30). This is confirmed by the controller 61, which at this time obtains detection information (detection result indicating the absence of the continuous paper 9) output from the continuous paper presence/absence detector 71.

If the absence of the continuous paper 9 has been confirmed in step 30, whether or not the feed width W2 of the replacement continuous paper 9B is larger than the feed width W1 of the continuous paper 9A (immediately) before being replaced (S31) is checked. The controller 61 obtains detection information output from the continuous paper width detector 72, thereby recognizing this checking. The detection information at this time is a detection result of a case where the feed width W has become larger than the immediately previous feed width W, that is, at a time when the feed width W changes from small to large.

If it has been confirmed, in step 31, that the feed width W of the continuous paper 9 becomes larger than the feed width W of the immediately previous continuous paper 9, the controller 61 controls the transfer performance adjuster 64 so as to increase the contact pressure of the second transfer roller 36 (cam mechanism 56) (S32).

Figure 7A:
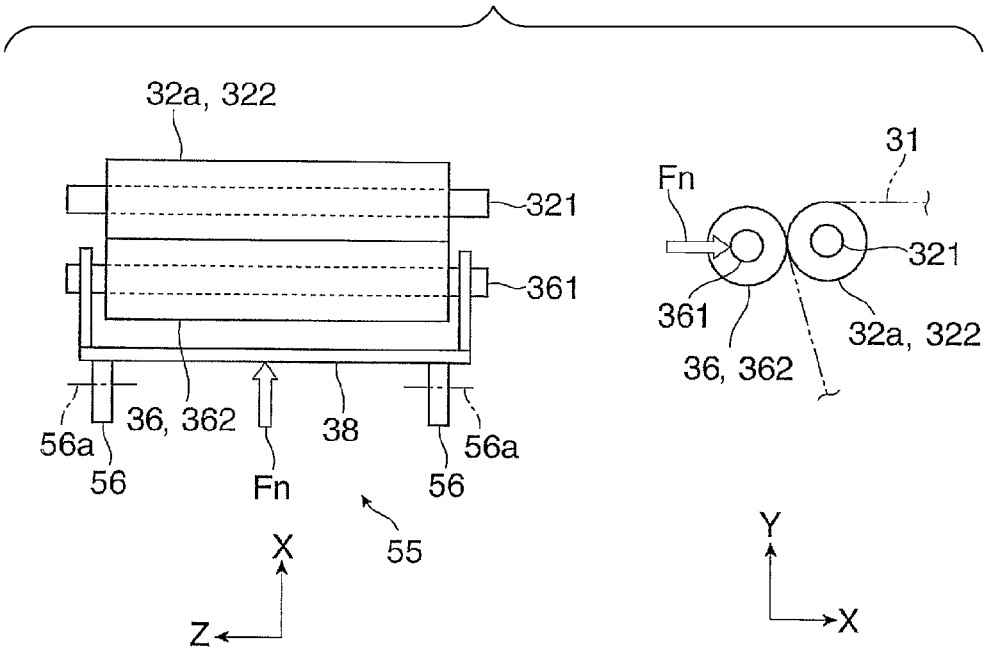
FIG. 7A is an explanatory view illustrating the structure of a transfer performance adjustment unit and a state of the second transfer roller and so forth during normal operation.
Figure 7B:
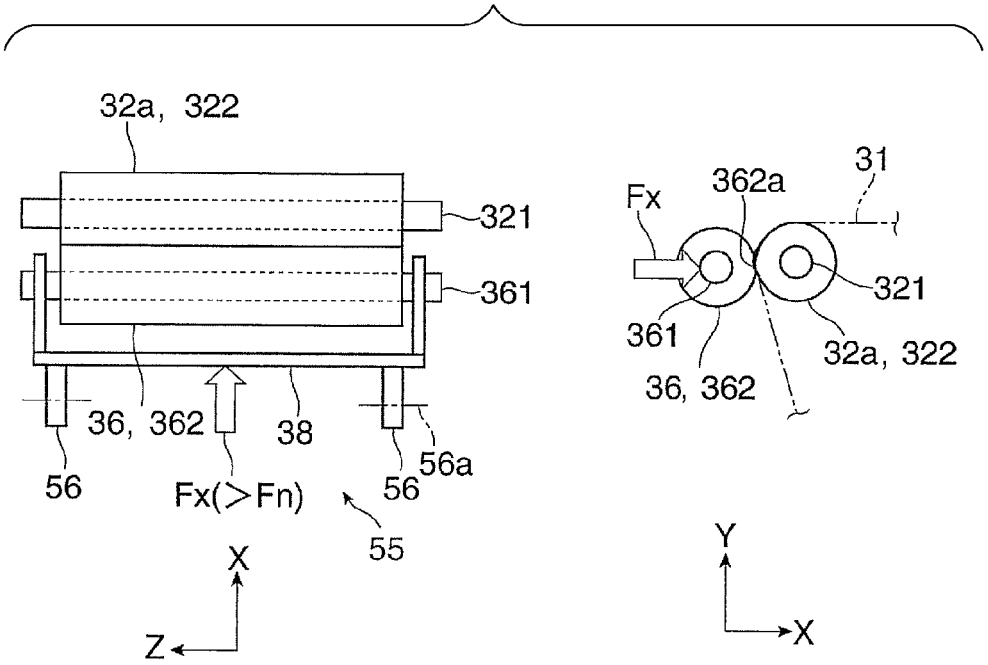
FIG. 7B is an explanatory view illustrating the structure of the transfer performance adjustment unit and a state of the second transfer roller and so forth for operation at an increased contact pressure.

In so doing, in the adjustment mechanism 55 for a contact pressure serving as an example of the adjuster 64, the eccentric cams of the cam mechanism 56 are moved from a position for applying a pressing force Fn (FIG. 7A) for normal operation to a position (FIG. 7B) for applying an increased pressing force Fx. This changes, in the adjustment mechanism 55, the force applied by the cam mechanism 56 to the support member 38 for the second transfer roller 36 from the pressing force Fn for normal operation to the increased pressing force Fx (>Fn). As a result, the second transfer roller 36 is more strongly pressed against the portion of the outer circumferential surface of the intermediate transfer belt 31 supported by the second transfer backup roller 32*a* as illustrated in FIG. 7B. Reference sign 362*a* illustrated in FIG. 7B indicates a portion of the roller body 362 of the second transfer roller 36 elastically deformed by being strongly pressed by the intermediate transfer belt 31 supported by the second transfer backup roller 32*a*.

After this operation of increasing the contact pressure of the second transfer roller 36 has been performed, the second transfer roller 36 at the separate position is moved to a position where the second transfer roller 36 is in contact with the portion of the outer circumferential surface of the intermediate transfer belt 31 supported by the second transfer backup roller 32*a* under the control of the controller 61 (S33). The second transfer roller 36 performs this movement in response to an operation of the contact/separation mechanism driver 63 of the contact/separation mechanism controlled by the controller 61. This causes the second transfer roller 36 to be directly in contact with the portion of the outer circumferential surface of the intermediate transfer belt 31 without the continuous paper 9 interposed therebetween as illustrated in FIG. 6B. The second transfer roller 36 is also moved to the contact position if it has been confirmed in step 31 that the feed width W of the new continuous paper 9 is not larger than the feed width W of the immediately previous continuous paper 9 (from S31 to S33 with S32 skipped).

The cleaning operation for the second transfer roller 36 is formally performed after the second transfer roller 36 has been moved to the contact position (S34). This cleaning operation for the second transfer roller 36 is performed by supplying the cleaning current from the transfer power supply unit 62 to the second transfer backup roller 32*a* under the control of the controller 61. While this cleaning operation is being performed, the image forming devices 21Y, 21M, 21C, and 21K do not perform a toner image forming operation, and only an operation for rotating the intermediate transfer belt 31 in the arrow B direction is performed in the intermediate transfer device 30.

Thus, due to supply of the cleaning current, an electric field E1, which electrostatically transfers the undesired adhering matter to the intermediate transfer belt 31, is formed between the second transfer roller 36 and the second transfer backup roller 32*a* with the intermediate transfer belt 31 interposed therebetween as exemplified in FIG. 6B. As a result, undesired adhering matter J that is typically electrostatically adhering to the second transfer roller 36 is subjected to action of the electric field E1 and transferred to the outer circumferential surface of the intermediate transfer belt 31.

In so doing, since there is no continuous paper 9 existing between the second transfer roller 36 and the intermediate transfer belt 31, the undesired adhering matter J is not transferred to the back side of the continuous paper 9 due to the action of the electric field E1. Furthermore, as has been described, it may be assumed that part of the undesired adhering matter J is charged to the opposite polarity. In this case, the undesired adhering matter J charged to the opposite polarity is also able to be transferred to the intermediate transfer belt 31 by, in the cleaning operation, alternately supplying the current of the opposite polarity to that of the transfer current and the current of the same polarity as that of the transfer current as the cleaning current.

Furthermore, undesired adhering matter J1 having been transferred to the outer circumferential surface of the intermediate transfer belt 31 at this time is transported to the belt cleaner 37 by the rotation of the intermediate transfer belt 31, and then removed by the belt cleaner 37 and collected. Thus, adherence of the undesired adhering matter J1 to the photosensitive drums 22 and so forth of the image forming devices 21 disposed, for example, downstream of the belt cleaner 37 in a rotational direction B of the intermediate transfer belt 31 is also avoided.

Furthermore, in the case where the feed width W of the replacement continuous paper 9B becomes larger than the feed width W of the immediately previous continuous paper 9, as exemplified in FIG. 7B, the second transfer roller 36 is in contact with the outer circumferential surface of the intermediate transfer belt 31 at a contact pressure increased by the adjustment mechanism 55 from that for the normal operation. Thus, the rotational shaft 361 of the second transfer roller 36, which is subjected to the large pressing force Fx applied at both end portions thereof, is entirely slightly bent, and accordingly, end portion sides of the roller body 362 of the second transfer roller 36 are strongly pressed against and in tight contact with the outer circumferential surface of the intermediate transfer belt 31. As a result, even when the smudges M are made at end portion sides of the second transfer roller 36, the undesired adhering matter J included in the smudges M may be efficiently subjected to the action of the electric field E1 so as to be transferred to the outer circumferential surface of the intermediate transfer belt 31. Thus, these smudges M may be easily removed.

Accordingly, as exemplified in FIG. 8, even when the smudges M are made due to adherence of the undesired adhering matter to portions of the outer circumferential surface (end portion sides) of the second transfer roller 36 outside left and right ends of the continuous paper 9A by repeatedly performing, for example, the image forming operation on the old continuous paper 9A having the relatively small feed width W1, the smudges M may be efficiently removed. Thus, even when the continuous paper 9A is replaced with the continuous paper 9B having the relatively large feed width W2 compared to the feed width W1 before replacement and the image forming operation is performed, smudging of the back side of the new continuous paper 9B by the smudges M made on the end portion sides of the second transfer roller 36 during the use of the old continuous paper 9A may be avoided.

The above-described cleaning operation for the second transfer roller 36 ends when, for example, a preset time period of cleaning is reached (S35).

If it has been confirmed that the cleaning operation for the second transfer roller 36 ends, the second transfer roller 36 at the contact position is moved to the position where the second transfer roller 36 is kept separated from the portion of the outer circumferential surface of the intermediate transfer belt 31 (S36). After that, in the case where the contact pressure of the second transfer roller 36 has been increased in step 32, the contact pressure is returned to the contact pressure for the normal operation (S37). In so doing, the second transfer roller 36 performs this movement in response to the operation of the contact/separation mechanism driver 63 of the contact/separation mechanism controlled by the controller 61. Furthermore, the contact pressure is returned by operation of the cam mechanism 56 of the adjustment mechanism 55 controlled by the controller 61. Specifically, the eccentric cams of the cam mechanism 56 are returned to the position for applying the pressing force Fn for the normal operation as illustrated in FIG. 7A.

Furthermore, the above-described cleaning operation for the second transfer roller 36 is not performed when it has been confirmed, in step 30, that there is the continuous paper 9 between the intermediate transfer belt 31 and the second transfer roller 36 (skipping processes from S31 to S37). This is confirmed by the controller 61, which at this time obtains detection information (detection result indicating the presence of the continuous paper 9) output from the continuous paper presence/absence detector 71. Assuming that the cleaning operation for the second transfer roller 36 is performed when the continuous paper 9 is present, the undesired adhering matter J on the second transfer roller 36 is transferred to the back side of the continuous paper 9, thereby smudging the back side of the continuous paper 9. However, because of the above-described skipping, such smudging of the back side of the continuous paper 9 may be reliably avoided.

Thus, operations relating to the cleaning operation for the second transfer roller 36 are completed. This changes the state of the image forming apparatus 1 to a state waiting for the next image forming operation (S38).

OTHER EXEMPLARY EMBODIMENTS

In the image forming apparatus 1 according to the first exemplary embodiment, as illustrated by a two-dot chain line in FIG. 4, it is possible that the controller 61 causes the cleaning operation for the second transfer roller 36 to be performed along with an image quality adjustment operation.

The image quality adjustment operation adjusts, for example, density, positions, and so forth relating to maintaining image quality. Furthermore, the image quality adjustment operation is performed at preset time. Representative examples of such preset time include, for example, time when the power is turned on, time when the number of times of image forming operation reaches a specified number of times (pages), time when the continuous paper 9 is replaced, and so forth.

The above-described image quality adjustment operation is performed, in a state in which the second transfer roller 36 is moved at the separate position in the image forming section 20, as follows: at least the image forming devices 21Y, 21M, 21C, and 21K and the intermediate transfer device 30 are operated so as to transfer through second transfer density detection toner images (patch images) and misregistration detection toner images (patch images) formed by the image forming devices 21Y, 21M, 21C, and 21K to a region other than image forming regions (an end portion or a region between adjacent image forming regions) of the outer circumferential surface of the intermediate transfer belt 31; the density detection toner images and the misregistration detection toner images are read by a reading sensor (not illustrated); and, the density detection toner images and the misregistration detection toner images are removed by the belt cleaner 37 at last. Furthermore, in the image quality adjustment operation, after the detection toner images have been read by the reading sensor, density variation and misregistration are detected, and required image forming conditions and so forth are adjusted in accordance with detection results. Specific examples of adjustment include, for example, an increase/decrease in the charging current and the developing current, an increase/decrease in the light amounts for light exposure using the light exposure devices 24, adjustment of the drawing positions during the light exposure, and so forth.

When such image quality adjustment operation is performed, a variety of detection toner images are formed on the outer circumferential surface of the intermediate transfer belt 31. Accordingly, part of the toner may remain on the intermediate transfer belt 31 and, during normal image forming operation, adhere to the second transfer roller 36 and part of the toner included in the toner images may fly up, leave the toner images, and adhere to the second transfer roller 36. Accordingly, when the cleaning operation for the second transfer roller 36 is performed along with the image quality adjustment operation, smudging of the second transfer roller 36 may be eliminated. Furthermore, performing of the image quality adjustment operation and the cleaning of the second transfer roller 36 without smudging the back side of the continuous paper 9 may be combined with each other to stabilize the image quality of images to be formed by the image forming apparatus 1.

Furthermore, when it is assumed that the second transfer roller 36 is smudged due to the image quality adjustment operation as described above, as exemplified in FIG. 4, the image quality adjustment operation and the cleaning operation for the second transfer roller 36 may be performed in the following order: the image quality adjustment operation is performed first (S20), and after that, the cleaning operation for the second transfer roller 36 is performed (S15). When these operations are performed in this order, even when the second transfer roller 36 is smudged with the undesired adhering matter J adhering thereto during performing of the image quality adjustment operation, this second transfer roller 36 may be reliably cleaned. In order to measure, for example, a system resistance at the second transfer position during the image quality adjustment operation, the cleaning operation for the second transfer roller 36 may be performed before the measurement of the system resistance. In this case, generation of errors in a measurement result due to the existence of the undesired adhering matter J may be avoided.

Furthermore, in the example of the configuration according to the first exemplary embodiment, during replacement of the continuous paper 9, the cleaning operation for the second transfer roller 36 is automatically started after the old continuous paper 9A has been removed and the transfer unit access door 205 has been closed (procedure in S14 and S15 illustrated in FIG. 4). However, this example is not limiting. As another configuration, for example, the following configuration or the like may be used: information indicating that it is required to instruct to start the cleaning operation for the second transfer roller 36 is displayed to the user in, for example, the display 52 of the operating display 50 after the transfer unit access door 205 has been closed, so that the cleaning operation for the second transfer roller 36 is started after it is instructed by the user. The cleaning operation for the second transfer roller 36 is not necessarily performed during replacement of the continuous paper 9 and may be performed at any time when there is no continuous paper 9 between the intermediate transfer belt 31 and the second transfer roller 36. For example, the cleaning operation for the second transfer roller 36 may be performed at a specified time during time when a detection result indicating that the continuous paper 9 is absent in accordance with the detection information from the continuous paper presence/absence detector 71 is obtained.

Furthermore, for the first exemplary embodiment, the controller 61 may be configured so as to perform control as follows: information indicating that the cleaning operation for the second transfer roller 36 is being performed and information indicating that this cleaning operation has ended are displayed in, for example, the display 52 of the operating display 50. Furthermore, the controller 61 may be configured so as to perform control as follows: information prompting the user to open the transfer unit access door 205, information prompting the user to load the replacement continuous paper 9B, and the like are displayed in, for example, the display 52 of the operating display 50 after the cleaning operation for the second transfer roller 36 has ended. This may allow the user to clearly understand that the image forming apparatus 1 is performing the cleaning operation for the second transfer roller 36, the cleaning operation has actually ended, or the details of operation to be performed next.

Furthermore, for the first exemplary embodiment, a system that is able to instruct to suspend or cancel the cleaning operation for the second transfer roller 36 when the cleaning operation is started may be used. Specifically, the following configurations may be used: a configuration in which an operating portion with which the user is able to instruct to suspend or cancel is displayed or disposed in, for example, the operating display 50; and a configuration in which control is performed so that the cleaning operation is forcibly terminated by opening the transfer unit access door 205 or another openable member opening and closing of which are detected.

Furthermore, in the example of the configuration according to the first exemplary embodiment, the continuous paper presence/absence detector (detection unit) 71 is disposed at a position on the exit side of the fixing device 40. However, the presence/absence detector (detection unit) 71 may be disposed, for example, around the second transfer roller 36. Furthermore, when the progress of the replacement of the continuous paper 9 is able to be recognized, the presence/absence detector (detection unit) 71 may be omitted.

In addition to the above description, regarding the image forming apparatus 1, the supply section 10, the image forming section 20, and the receiving section 15 may have different configurations or be of different types in the image forming apparatus as long toner images are transferred onto the continuous paper 9 so as to form images in the image forming apparatus. The image forming section 20 may be configured, for example, so as to use a direct transfer system in which the intermediate transfer device 30 is not used. In this case, in the image forming section 20, the first transfer rollers may be in contact with latent image forming bodies such as photosensitive drums. Also in this case, cleaning operation for the first transfer rollers may be performed when there is no continuous paper between the first transfer rollers and the latent image forming bodies.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an intermediate transfer belt that holds an unfixed image;

a transfer member that presses a continuous medium against the intermediate transfer belt and that causes the image to be transferred to the medium;

a controller that allows a cleaning operation in which undesired adhering matter adhering to the transfer member is transferred to the intermediate transfer belt to be performed when the medium does not exist between the intermediate transfer belt and the transfer member;

a width detection unit that detects a feed width of the medium; and an adjustment unit that adjusts transfer performance for transferring the undesired adhering matter to the intermediate transfer belt during the cleaning operation, wherein, when the width detection unit detects a larger feed width than an immediately previous feed width, the controller controls, before the cleaning operation is performed, the adjustment unit so as to increase the transfer performance, wherein the adjustment unit is an adjustment mechanism that adjusts a contact pressure of the transfer member against the intermediate transfer belt, and wherein, when the width detection unit detects a larger feed width than an immediately previous feed width, the controller controls the adjustment mechanism so as to increase the contact pressure.

2. The image forming apparatus according to claim 1, wherein the controller does not cause the cleaning operation to be performed when the medium exists between the intermediate transfer belt and the transfer member.

3. The image forming apparatus according to claim 1, wherein the controller uses at least a time period during which the medium is removed for replacement of the medium as a time period during which the medium does not exist.

4. The image forming apparatus according to claim 1, further comprising:

an openable door through which part of the image forming apparatus including the transfer member is exposed to an outside, wherein the controller causes the cleaning operation to start after the openable door has been opened, and then, closed again.

5. The image forming apparatus according to claim 4, further comprising:

a display in which information is displayed, wherein, when the openable door is opened, the controller causes a first piece of information to be displayed in the display, and wherein the first piece of information instructs to close the openable door without loading the medium in a case where the cleaning operation is wished.

6. The image forming apparatus according to claim 4, further comprising:

a display in which information is displayed, wherein, when the openable door is opened, the controller causes a second piece of information to be displayed in the display, and wherein the second piece of information instructs to load the medium, and then, close the openable door in a case where the cleaning operation is not wished.

7. The image forming apparatus according to claim 1, wherein the controller causes the cleaning operation to be performed along with an image quality adjustment operation.

8. The image forming apparatus according to claim 7, wherein the controller causes the cleaning operation to be performed after the image quality adjustment operation has been performed.

9. The image forming apparatus according to claim 1, further comprising:

a presence/absence detection unit that is disposed in a portion of a transport path of the medium and that detects presence and absence of the medium, wherein the controller uses detection information of the presence/absence detection unit.

10. The image forming apparatus according to claim 1, further comprising:

a power supply unit that supplies a transfer current that forms between the intermediate transfer belt and the transfer member an electric field that causes the image to be transferred to the medium, wherein, to perform the cleaning operation, the controller controls the power supply unit so as to supply a cleaning current that forms an electric field that causes the undesired adhering matter to be transferred to the intermediate transfer belt.

* * * * *